United States Patent [19]

Gros

[11] Patent Number: 4,562,708

[45] Date of Patent: Jan. 7, 1986

[54] VIDEO GAME SECURITY GUARD APPARATUS

[76] Inventor: Lawrence J. Gros, P.O. Box 186, Labadieville, La. 70372

[21] Appl. No.: 686,099

[22] Filed: Dec. 24, 1984

Related U.S. Application Data

[63] Continuation of Ser. No. 431,344, Sep. 30, 1982, abandoned.

[51] Int. Cl.[4] ..... E05B 65/00

[52] U.S. Cl. ..... 70/94; 70/159

[58] Field of Search ..... 70/94, 58, 159–160, 70/162–164; 292/259, 288, 338, 339

[56] References Cited

U.S. PATENT DOCUMENTS

| | | | |
|---|---|---|---|
| 1,825,726 | 10/1931 | Gredell | 70/164 |
| 2,130,216 | 9/1938 | Zaminovich | 292/259 |
| 2,297,579 | 9/1942 | Norberg | 70/164 |
| 3,665,736 | 5/1972 | Wilson | 70/78 |
| 4,397,499 | 8/1983 | Work | 292/259 |
| 4,418,551 | 12/1983 | Kochacks | 70/18 |

*Primary Examiner*—Robert L. Wolfe

[57] ABSTRACT

A security locking device for coin-operated video game machines comprising means for preventing access to the coin box of the machine and means for preventing access through the service panel of the machine.

7 Claims, 10 Drawing Figures

VIDEO GAME SECURITY GUARD APPARATUS

This is a continuation of Ser. No. 431,344, filed Sept. 30, 1982 and now abandoned.

GENERAL BACKGROUND OF THE INVENTION

1. Field of the Invention

The present invention relates to an improved locking device for coin-operated machines, and more particularly to security guards for double doors on the front of video game machines and security guards for the rear panel of such video game machines.

2. General Background

In the recently and rapidly expanding video amusement game industry, it is customary to place a coin-operated video game machine in a publicly accessible location without providing for continuous surveillance. The coin boxes of such machines are emptied of their receipts on a periodic basis, normally once per day, or even less frequently depending on the location and revenue production. The cost of individual surveillance would be prohibitive; yet theft by break-ins and vandalism is rampant.

Fasteners and locking devices are known in the art and are shown in the following U.S. Pat. Nos. 4,194,775, 4,119,237, 4,047,686, 4,023,386, 1,814,343, 1,711,535, and 1,262,378.

The present invention solves the problems and shortcomings of the prior art in that none of the prior art devices are specifically designed for video coin-operated game machines.

It is an object of the present invention to provide a locking device with interlocking portions without the use of hinges or springs which can fatigue or rust.

It is a further object of the present invention to provide a simple, inexpensive yet effective security guard system for video game machine apparatus.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and, wherein.

DETAILED DESCRIPTION OF THE PRESENT INVENTION

Figures 1, 2, 3, 4, 5, 6, 7, 8, 9, 10:
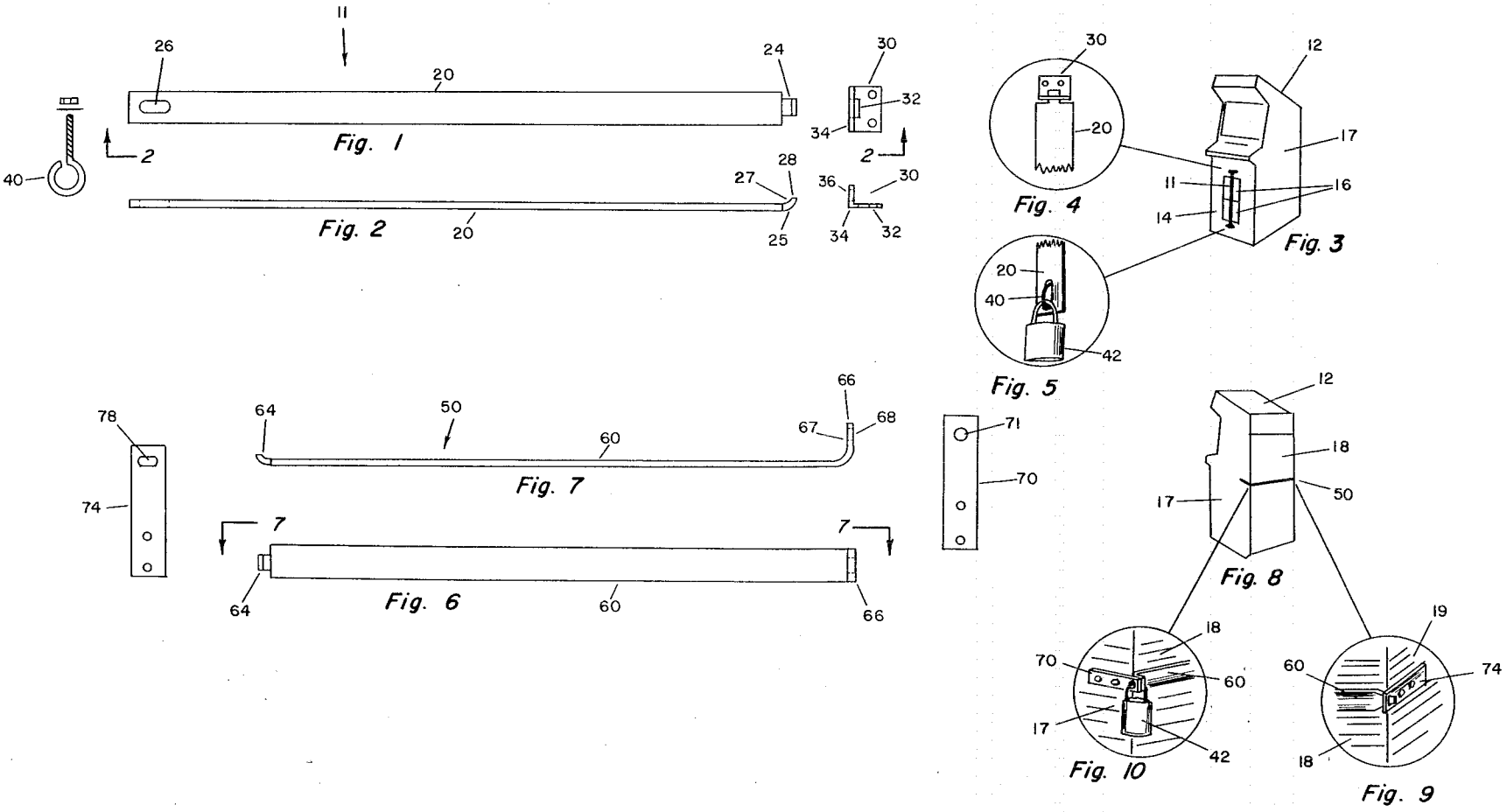
FIG. 1 is an exploded plan view of the frontal security guard of the apparatus of the present invention.
FIG. 2 is an inverted side elevational view of the security guard of FIG. 1 taken along line 2—2 in FIG. 1.
FIG. 3 is a perspective view of the security guard of FIG. 1 assembled on the front panel of a typical video game apparatus.
FIG. 4 is a fragmentary detailed view of the security guard of FIG. 1 illustrating the interlocking of the bar and receiving end member.
FIG. 5 is a fragmentary detailed view of the security guard of FIG. 1 illustrating the interlocking of the eye bolt, bar and lock thereof.
FIG. 6 is an exploded plan view of the rear security guard of the apparatus of the present invention.
FIG. 7 is a side elevational view of the bar portion of the security guard of FIG. 6 taken along line 7—7 of FIG. 6.
FIG. 8 is a perspective view of the security guard of FIG. 6 assembled on the rear panel of a typical video game apparatus.
FIG. 9 is a fragmentary detailed view of the security guard of FIG. 8 illustrating the interconnection of the bar and receiving member thereof.
FIG. 10 is a fragmentary detailed view of the security guard of FIG. 8 illustrating the interconnection of the bar, end member and lock thereof.

The apparatus of the present invention is comprised of frontal security guard system 11 and rear security guard system 50 for coin-operated video game apparatus 12 as shown in application in FIGS. 3 and 8. The front security guard device 11 is comprised of an elongated flat bar member 20 provided with a curved tongue portion or projection 24 at one end thereof. The other end is provided with a longitudinally extended slot 26. L-shaped receiving end member 30 is provided with upper notch 32 and lower notch 36 and transverse edge or lip portion 34 such that curved tongue portion 24 can be inserted through lower notch 36 and then end portion 28 through upper notch 32 such that the lower surface 27 of tongue 24 contacts the upper surface of L-shaped end member 30 and the upper surface 25 of tongue 24 maintains contact with the lower surface of edge or lip portion 34 as best seen in FIG. 4. As seen in FIG. 3, L-shaped receiving end member 30 is mounted on the upper portion of front panel 14 of video game apparatus 12 in such a manner that when lip portion 24 is received by end member 30 as shown in FIG. 4, bar portion 20 will longitudinally cover the entire length of double doors 16 which contain the coin box (not shown) of video game apparatus 12. By providing curved tongue portion 24 and L-shaped end member 30 in the manner described above, a frictional force will exist between end member 30 and edge 28 of tongue portion 24 by the force of transverse edge 34 upon the upper portion 25 of tongue 24.

As seen in FIGS. 1 and 5, eye bolt 40 is provided in the lower portion of front panel 14 of video game apparatus 12 to permit slot 26 of bar 20 to slip over bolt 40 after which conventional padlock 42 is used to lock the bar 20 on the bolt 40. With the force provided at the upper portion of the front panel security guard system 11 by curved portion 24 and the lock 42 at the opposite end, double doors 16 for access to coin box (not shown) interior of video game 12 are firmly secured.

In that access to the coin box of video game apparatus 12 is often sought by thieves through rear panel 18 of video game apparatus 12 and vandalism is an additional concern, rear security guard device 50 is provided as shown in FIGS. 6–10. Rear seurity guard device 50 comprises an elongated bar member 60 provided with a curved tongue portion or projection 64 at one end thereof in much the same manner as bar member 20. However, the opposite end of bar member 60 is provided with a second curved portion 66 which forms a substantially right angle with bar 60 at section 67. Curved portion 66 is provided with an aperture 68 to be employed as described below. Rear security guard device 50 further comprises a pair of end members 70, 74. End member 70 is provided with aperture 71 in the upper portion thereof and end member 74 is provided with transversely extending slot 78 in the upper portion thereof. As seen in FIGS. 8–10, end members 70 and 74 are mounted on side panels 17, 19 of video game apparatus 12 such that aperture 71 and slot 78 overhang the corners formed between rear panel 18 and side panels 17, 19 of video game apparatus 12, as best shown in the fragmentary views of FIGS. 9 and 10. Bar 60 is then mounted on video game apparatus 12 by inserting curved tongue portion 64 through transverse slot 78 of end member 74 and mating curved portion 66 of bar 60 with the portion of end member 70 having aperture 71 in such a manner as to align aperture 71 with aperture 68. Upon alignment of apertures 68, 71 a second padlock 42 is provided so as to secure bar 60 to end member 70 thereby securing the rear panel of video game 18.

What is claimed as invention is:

1. A security locking device for a coin-operated video game machine comprising:

a. a coin-operated video game provided in a housing having:
   i. a front panel;
   ii. at least two side panels and a service panel;
   iii. a coin box interior of said video game machine housing; and
   iv. an access means to said coin box provided in said front panel;

b. means for preventing access to said coin box of said video game machine housing through said access means, said means comprising:
   i. a first elongated locking bar having a slot at one end thereof and the other end having a curved lip portion;
   ii. means mounted on the upper portion of said front panel for receiving said curved lip portion of said first bar;
   iii. means adapted to receive said slotted end of said first bar and mounted on the lower portion of said front panel; and
   iv. a lock for removably fastening said first bar to said front panel said lock engaging said means adapted to receive said slotted end of said first bar; and c. means for preventing access to the interior of said housing through said service panel of said video game machine housing, said means comprising:
   i. a second elongated bar having a slot at one end thereof and the other end having a curved lip portion;
   ii. means for receiving said curved lip portion of said second bar, said means being mounted to the first of said side panels of said video game machine housing, said first side panel abutting said service panel;
   iii. means for abutting said slotted end portion of said second elongated bar, said means being mounted to the second of said side panels opposite said first side panel and abutting said service panel; and
   iv. a lock for removably fastening said second bar to said housing said lock engaging said means for abutting said slotted end of said second bar and said curved lip portion of said second elongated bar.

2. The apparatus of claim 1 wherein said first and second elongated bars are rigid members.

3. The apparatus of claim 1 wherein said means adapted to receive said slotted end of said first bar is an eye bolt.

4. The apparatus of claim 1 wherein said locks are padlocks.

5. The apparatus of claim 1 wherein said means for abutting said slotted end portion of said second elongated bar is provided with an aperture for alignment of said slot of said second elongated bar.

6. The apparatus of claim 1 wherein said service panel is the rear panel of said video game machine.

7. The apparatus of claim 6 wherein said means for preventing access through said service panel is mounted horizontally across said rear service panel of said video game apparatus.

* * * * *